United States Patent [19]

Roe

[11] Patent Number: 4,516,338

[45] Date of Patent: May 14, 1985

[54] GIMBAL MOUNTED ON FRAME WITH HEAVY METAL PLATE SIDES

[75] Inventor: Jonas L. Roe, Santa Cruz, Calif.

[73] Assignee: Terradyne Limited, Georgetown, Cayman Islands

[21] Appl. No.: 570,846

[22] Filed: Jan. 16, 1984

Related U.S. Application Data

[60] Division of Ser. No. 313,155, Oct. 20, 1981, Pat. No. 4,438,575, which is a continuation of Ser. No. 93,020, Nov. 9, 1979, abandoned.

[51] Int. Cl.[3] ..... E02F 5/06

[52] U.S. Cl. ..... 37/4; 37/86; 37/191 R

[58] Field of Search ..... 37/4, 191 R, 192 R, 37/183, 86; 198/707, 713

[56] References Cited

U.S. PATENT DOCUMENTS

| | | | |
|---|---|---|---|
| 891,004 | 6/1908 | Ream | 198/707 X |
| 1,739,122 | 12/1929 | Brown | 37/88 |
| 2,024,894 | 12/1935 | Taylor | 37/191 R |
| 2,320,196 | 5/1943 | Roe | 37/89 X |
| 2,478,302 | 8/1949 | Moyer | 198/707 |
| 2,597,036 | 5/1952 | Roe | 37/86 X |
| 2,701,048 | 2/1955 | Harrison | 198/707 |
| 2,753,637 | 7/1956 | Thomas | 37/88 |
| 2,962,822 | 12/1960 | Roe | 37/86 X |
| 3,035,821 | 5/1962 | Peterson | 37/86 |
| 3,738,031 | 6/1973 | Lott | 37/89 X |
| 4,030,217 | 6/1977 | Satterwhite | 37/190 |
| 4,438,575 | 3/1984 | Roe | 37/4 |

FOREIGN PATENT DOCUMENTS 126986 5/1919 United Kingdom .

*Primary Examiner*—E. H. Eickholt

*Attorney, Agent, or Firm*—Wenderoth, Lind & Ponack

[57] ABSTRACT

The invention provides a continuous excavating apparatus principally designed for use in mining operations and includes an elongated frame having heavy upright side walls and a mobile support mechanism. At its front end the frame mounts an endless bucket line for pivotal motion about both an upright and a transverse axis, the heavy frame providing a counterbalance for the forces generated during the excavating operation. The buckets are mounted on hinge pins whose enlarged ends engage supporting sprockets in a fashion to reduce and distribute wear resultant from normal operation, and the buckets include replaceable excavating teeth enabling ready replacement when required.

9 Claims, 5 Drawing Figures

FIG_3
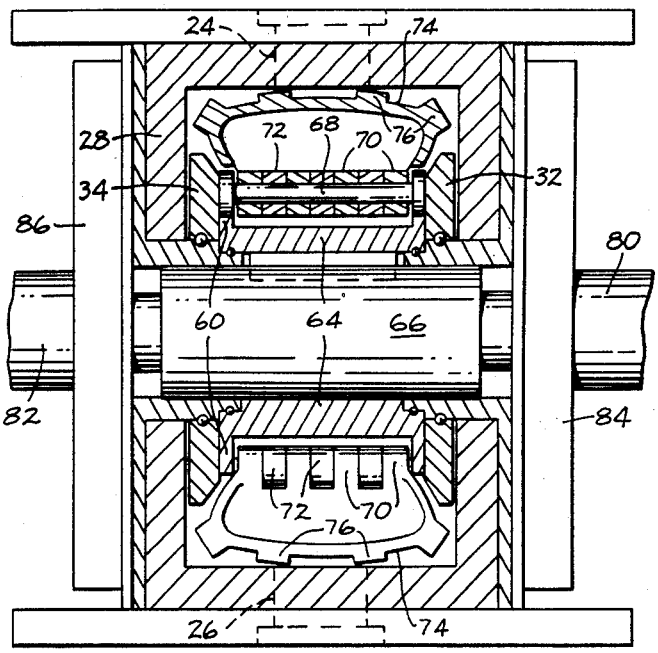
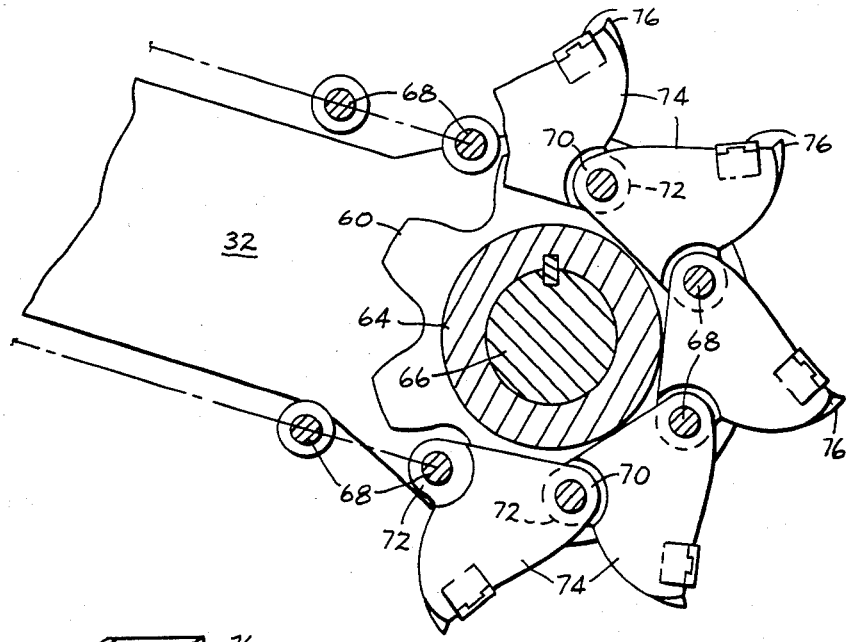
FIG_4
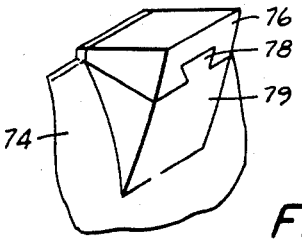
FIG_5

GIMBAL MOUNTED ON FRAME WITH HEAVY METAL PLATE SIDES

This application is a divisional application of Ser. No. 313,155 filed Oct. 20, 1981, now U.S. Pat. No. 4,438,575, which in turn is a continuation application of Ser. No. 93,020 filed Nov. 9, 1979 and now abandoned.

FIELD OF THE INVENTION

The present invention relates generally to powered excavating apparatus and more particularly to a combined excavating and conveying apparatus arranged to dig and convey large quantities of material such as ore in a mining operation.

BACKGROUND OF THE INVENTION

In many mining operations, digging or breakout forces in the neighborhood of 200,000 pounds are required, and at the same time, for practical utilization, the excavated material must be removed at rates approaching 100 tons per hour. With existent equipment these two practical requirements are not achieved. For example, mechanical devices such as backhoes and front end loaders could possibly deliver the requisite forces but have not the capacity to remove the material in such large quantities. On the other hand, certain boom-mounted rotary heads can remove the material at adequate rates but are not only incapable of delivering the requisite forces but also establish force components which tend to move the entire machine sideways so as to render its operation impractical.

Both problems are aggravated when one wishes to perform the excavating and conveying operation in a mining tunnel whose lateral dimensions conventionally are no more than six feet high and five feet wide, since the mentioned breakout or digging forces are sufficient to lift or transversely displace the mobile carrier for the equipment.

SUMMARY OF THE PRESENT INVENTION

Accordingly, it is the general objective of the present invention to provide a continuous excavating apparatus having a minimum profile or contour so that it can be utilized in a confined area such as a mining tunnel, and yet is capable of providing the requisite excavating forces and of conveying the excavated material at a relatively high rate of speed, approaching 100 tons per hour.

Briefly, this objective is achieved by providing a heavy elongated frame whose lateral dimensions are limited so that is can pass through a tunnel of dimensions no more than six feet in height and five feet in width, yet which is of sufficient weight so that experienced forces during the excavating and conveying operations can be accommodated. More particularly, the elongated frame includes very heavy side walls, preferably in the form of four side plates or walls, each pair of which are welded or otherwise joined at their edges to extend longitudinally in a generally horizontal direction to provide a total mass approaching 50 tons. The pairs of side plates are joined by transverse bracing plates in spaced relation to provide a channel or generally box-like configuration which for mobility is supported on mobile support elements such as endless tracks which are preferably disposed below the frame to reduce its lateral dimensions. In addition, the endless tracks are preferably supported to project forwardly from the front end of the frame which, in turn, extends beyond the rear extremity of the endless tracks, where it mounts the electric motor or other prime mover, which not only is arranged to drive the endless tracks to provide the requisite mobility of the unit but also serves in conjunction with the weight of the frame itself as a counterbalance against the digging forces, which are applied at a spaced distance in front of the forward end of the frame by an excavating boom.

Such excavating boom is gimbal mounted so as to pivot about a substantially upright axis adjacent the forward end of the frame, enabling lateral swinging motion thereof beyond the lateral contour of the frame, and is also mounted for pivotal adjustment about a transverse axis so that it can be pivoted both upwardly and downwardly beyond the vertical dimensions of the frame, thus enabling a tunneling operation having sufficient lateral dimensions so that the entire machine may be moved therethrough during the continuous excavating and conveying operation.

The excavating boom includes spaced side plates that are supported from the mentioned gimbal and carry at their opposite extremities sprockets that support an endless bucket line, which is caused to move continuously through actuation by hydraulic motors which are in turn driven by a hydraulic pump connected to the same electric motor.

Because of the extreme forces of excavation, the hydraulic bucket line includes buckets with digging or excavating teeth which can be readily replaced and hinges engaging common pivot shafts having enlarged ends which contact drive sprockets so that during operation, the enlarged shaft ends roll on the sprockets and cause the central portion of the shaft to rotate in contact with the hinges, thus to evenly distribute shaft wear.

The excavating extremities of the buckets whereat they engage the material to be mined or otherwise excavated move upwardly so that the digging forces are counterbalanced by the entire weight of the frame and other machine elements such as the described motor and endless tracks. Even when the bucket line is angled laterally, the great weight of the opposite side plates functions as an effective counterbalance. The buckets are arranged to discharge the excavated material onto one end of an endless conveyor which extends rearwardly between the frame plates mentioned hereinabove. At its remote end beyond the frame, the conveyor will, in turn, discharge the material into a truck or other suitable receptacle for removal to a processing station or storage.

BRIEF DESCRIPTION OF THE DRAWINGS

The present invention, as briefly summarized hereinabove, will be more fully understood by reference to the following detailed description of the exemplary structure shown in the accompanying drawings wherein:

FIG. 3 is a transverse sectional view taken along line 3—3 of FIG. 1 illustrating the gimbal mounting of the excavating boom and details of the bucket structure, FIG. 4 is a fragmentary longitudinal sectional view through the excavating boom illustrating additional details of its construction, and FIG. 5 is a fragmentary perspective view of an excavating tooth on the bucket structure.

DETAILED DESCRIPTION OF THE EXEMPLARY EMBODIMENT OF THE INVENTION

Figures 1, 2:
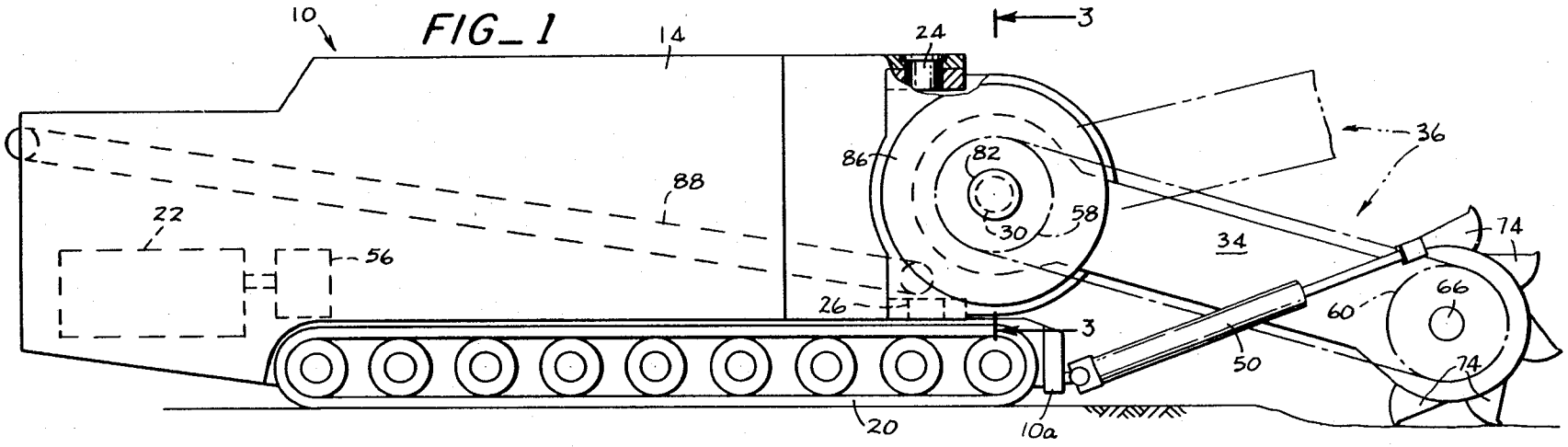
FIG. 1 is a side elevational view of a continuous excavating apparatus embodying the present invention.
FIG. 2 is a top plan view thereof.

With initial reference to FIGS. 1 and 2, the continuous excavating apparatus embodying the present invention includes a main frame 10 having most of its weight in substantially vertical side walls 12, 14, each formed preferably by a pair of contiguous plates which are welded or otherwise secured at their front, rear, and the top and bottom edges thereof. The frame plates are joined by transverse braces 16, 18 so that the overall configuration of the frame is in the form of a hollow channel or box-like configuration, within which certain additional elements of the apparatus can be housed, as will be explained in detail hereinafter.

To provide mobility of the heavy elongated main frame 10, a pair of conventional endless tracks 20 are mounted therebelow in a conventional fashion but at a position so that the endless tracks project at the forward end of the main frame 10 therebeyond but are recessed from the rearward end of the frame, for a purpose which will become apparent hereinafter. As can be seen, particularly by reference to FIG. 2, the endless tracks are confined within the lateral contours of the frame so that its overall width is less than five feet and the endless tracks have a height such that, when added to the height of the side plates, provides an overall vertical dimension of less than six feet. Thus the entire elongated frame and the mobile carriers therefor can pass readily through a tunnel having lateral dimensions no more than six feet in height and five feet in width.

To power the endless tracks and certain additional equipment to be described hereinafter, an electric motor 22 of appropriate power is mounted at the rearward end of main frame 10 on one of the mentioned transverse braces, the precise drive arrangement to the endless tracks being conventional and thus not described in further detail.

Adjacent the forward extremity of the elongated main frame 10 the mentioned upper and lower transverse braces 16, are joined rigidly to the side walls 12, 14 to support gimbal pins 24, 26 that rotatably carry an open rectangular gimbal frame which, as best shown in FIG. 3, can pivot about a generally upright axis and is, in turn, arranged to pivotally support on a transverse shaft 30 the parallel side plates 32, 34 of an excavating boom, generally indicated at 36, enabling its pivotal adjustment about a transverse axis so that the excavating boom can be pivoted both vertically and transversely an amount sufficient so that its extremity can more beyond the lateral and upright contour of the described supporting frame, as indicated by phantom lines in FIGS. 1 and 2, thus enabling a tunnel to be excavated which will subsequently allow the passage of the entire frame therethrough.

The side plates 32, 34 of the excavating boom 36 are held in laterally spaced relation by simple rigid metal braces 33 and the outer surfaces thereof mount balls 40, 42 for universal connection to ball sockets 44, 46 at the forward ends of double-acting hydraulic rams 48, 50 whose opposite extremities are universally joined to a forward extension 10*a* of the main frame 10 by similar ball and socket joints 52, 54 to allow the excavating boom to be adjusted vertically or horizontally through actuation of the hydraulic rams 48, 50 by a hydraulic pump 56 that is driven by the previously described electric motor 22. One valve (not shown) is associated in a conventional fashion with each hydraulic ram and is arranged to supply hydraulic pressure to one or the other end of its associated ram so that, as will be apparent, if both valves are open in one direction, both hydraulic rams will extend or retract to raise or lower the excavating boom, whereas on the other hand, if one valve is open in one direction while the other is open in the opposite direction, a lateral motion of the boom will occur; for example, to the phantom-line disposition shown in FIG. 2.

Between opposite ends of the described boom side plates 32, 34 laterally-spaced sprockets 58, 60 are mounted at the extremities of tubes 62, 64 which are keyed to mounting shafts, one of which is the previously described shaft 30 (see FIG. 3) and the other of which is an idler shaft 66 (see FIG. 4) rotatably supported between the side plates 32, 34 at the remote free end of the excavating boom 36. Each pair of sprockets engages the enlarged opposite ends of a hinge pin 68 which is arranged in bridging relationship between the laterally-spaced sprockets to rotatably extend through a piano-hinge connection in the form of interdigitated hinges 70, 72 at the front and rear of adjacent excavating buckets 74, which provide the material excavating elements of the unit. When it is remembered that considerable forces are encountered during the excavating operation, the enlarged ends of the pin 68 will rotate to provide only rolling friction with the engaged sprocket, thus to reduce sliding friction and extend the useful life of the elements to a considerable extent. Furthermore, it will be seen that each hinge pin 68 common to the foremost extremity of one bucket and the rearmost extremity of the adjacent bucket will rotate in the hinges 70, 72, thus to distribute wear and maintain the roundness of the hinge pin and the hinges.

In consideration of the extreme wear experienced by the digging ends of the excavating buckets, replaceable hard teeth 76 are utilized, and, as best shown in FIG. 5, each tooth includes a dove-tail connection 78 between it and its supporting element, which in turn is backed up by the bucket 74 and an integral wedge 79 so as to enable replacement thereof after continued wear over an extended period.

The line of buckets mounted on the sprockets is arranged for counterclockwise motion, as shown in FIG. 1, when driven by a pair a hydraulic motors 80, 82 which are connected to opposite ends of the sprocket-mounting shaft 80 at the inner end of the bucket line by suitable gear reduction units 84, 86, such hydraulic motors each being capable of delivering as much as 150 horsepower when energized by the hydraulic pump 56 driven by the previously described electric motor 22.

Utilization of the described hydraulic actuating mechanism enables a ready variation in the requisite power dependent upon the resistance of the material being engaged by the line of excavating buckets. When the buckets engage the material, as can be readily visualized by reference to FIG. 1, they will be moving in sequence in an upward direction, tending to rotate or pivot the entire machine about a transverse pivot formed at the forward end of the endless tracks. Since this pivot point is forwardly of most of the weight of the heavy frame and the elements mounted thereon, considerable forces may be generated without moving the frame about this transverse axis, thus to assure the requisite application of force during the excavating operation. Furthermore, if the excavating boom 36 is operating at a lateral angle such as indicated in phantom lines in FIG. 2, the reactive force components tending to rotate the main frame 10 about its longitudinal axis will be counterbalanced by the weight of the opposite side wall.

Material excavated and carried by the excavating buckets will be dumped therefrom as they pass in succession over the rear sprocket 58 onto a suitable endless conveyor 88 which lies thereunder and is mounted for conveyance of material deposited thereon beyond the rear end of the frame at an upper elevation so that the material conveyed on the belt can be dumped into a suitable truck or other receptacle (not shown) for removal and subsequent processing. The conveyor 88 is supported between the frame plates and is powered by suitable connection to the motor 22.

Obviously, many variations and/or alterations in this structure as specifically described can be made without departing from the spirit of the invention, and the foregoing description of one embodiment is to be considered as purely exemplary and not in a limiting sense, and the actual scope of the invention is to be indicated only by reference to the appended claims.

What is claimed is:

1. Continuous excavating apparatus comprising: a longitudinally elongated, low, narrow frame including a first side-counterweight and a second side-counterweight transversely spaced therefrom, each side-counterweight being formed of a heavy metal elongated plate means of substantially greater length that its width or height; a mobile ground engaging means for said frame; a gimbal mounted on the forward end of said frame for pivotal motion about a vertical axis; a boom mounted on said gimbal for movement about a horizontal axis; said boom including an endless excavating bucket line for digging material at the movable free end of said boom to cause, while digging, a force tending to pivot the frame about a leading end of said ground engaging means; means connecting said boom to said frame at a level substantially the same as the ground engaging means for adjusting the boom and for resisting said force; said frame having an effective center of gravity and sufficient dead weight to provide a greater counter force around said leading end of said ground engaging means than the pivoting force to maintain said bucket line in an excavating position and said heavy metal plate means having a center of gravity and sufficient dead weight to provide a counter force to forces tending to rotate said frame about its longitudinal axis when performing an off center digging operation.

2. Apparatus as claimed in claim 1, in which said mobile ground engaging means is a driven pair of endless tracks, located beneath said frame and substantially within the lateral extent thereof and extending forwardly of said forward end of said frame, said frame overhanging the rear end of said endless tracks.

3. Apparatus as claimed in claim 1 further comprising conveyor means extending upwardly and rearwardly from a point adjacent said forward end to a point adjacent the rear of the frame and being located between said side-counterweights for receiving material from said bucket line.

4. Apparatus as claimed in claim 1 wherein said plate means each includes a pair of heavy plates.

5. Apparatus as claimed in claim 2 wherein said plate means each includes a pair of heavy plates.

6. Apparatus as claimed in claim 3 wherein said plate means each includes a pair of heavy plates.

7. Apparatus according to claim 1 wherein said endless bucket line includes a plurality of excavating buckets, adjacent buckets being pivotally connected by a common hinge pin, and a pair of spaced sprockets rotatively supported at each end of said boom and engaging opposite ends of each of said common pins, each of said pins having enlarged ends arranged for engagement with said sprockets to cause a central portion of the pin to rotate during operation.

8. Apparatus according to claim 2 wherein said endless bucket line includes a plurality of excavating buckets, adjacent buckets being pivotally connected by a common hinge pin, and a pair of spaced sprockets rotatively supported at each end of said boom and engaging opposite ends of each of said common pins, each of said pins having enlarged ends arranged for engagement with said sprockets to cause a central portion of the pin to rotate during operation.

9. Apparatus according to claim 3 wherein said endless bucket line includes a plurality of excavating buckets, adjacent buckets being pivotally connected by a common hinge pin, and a pair of spaced sprockets rotatively supported at each end of said boom and engaging opposite ends of each of said common pins, each of said pins having enlarged ends arranged for engagement with said sprockets to cause a central portion of the pin to rotate during operation.

* * * * *